US008915307B2

(12) United States Patent
Lelic et al.

(10) Patent No.: US 8,915,307 B2
(45) Date of Patent: Dec. 23, 2014

(54) ATOMIZING NOZZLE FOR A FIRE SUPPRESSION SYSTEM

(75) Inventors: Muhidin Lelic, Londonderry, NH (US); Giuliano Amantini, East Haven, CT (US); May L. Corn, Wethersfield, CT (US); Robert G. Dunster, Slough (GB); Rob J. Lade, Marlow (GB); Ravi K. Madabhushi, Longmeadow, MA (US); Seth Sienkiewicz, Franklin, MA (US); Marios C. Soteriou, Middletown, CT (US)

(73) Assignee: UTC Fire & Security Corporation, Farmington, CT (US)

( * ) Notice: Subject to any disclaimer, the term of this patent is extended or adjusted under 35 U.S.C. 154(b) by 778 days.

(21) Appl. No.: 13/140,611

(22) PCT Filed: Dec. 18, 2008

(86) PCT No.: PCT/US2008/013840

§ 371 (c)(1),
(2), (4) Date: Jun. 17, 2011

(87) PCT Pub. No.: WO2010/071622

PCT Pub. Date: Jun. 24, 2010

(65) Prior Publication Data

US 2011/0259617 A1 Oct. 27, 2011

(51) Int. Cl.

| | |
|---|---|
| ***B05B 1/34*** | (2006.01) |
| ***B05B 1/26*** | (2006.01) |
| ***B05B 3/02*** | (2006.01) |
| ***A62C 35/00*** | (2006.01) |
| ***A62C 37/08*** | (2006.01) |
| ***A62C 31/05*** | (2006.01) |
| ***A62C 35/02*** | (2006.01) |
| ***A62C 99/00*** | (2010.01) |

(52) U.S. Cl.

CPC ..... *A62C 31/05* (2013.01); *A62C 35/023* (2013.01); *A62C 99/0072* (2013.01)

USPC ..... 169/37; 169/6; 239/222.11; 239/463; 239/497; 239/523

(58) Field of Classification Search

CPC ..... B05B 1/34; B05B 1/26; B05B 3/02; B05B 15/06; B05B 1/262; B05B 1/267; B05B 3/00; F23D 11/04; A62C 35/00; A62C 37/08; A62C 37/50

USPC ..... 169/37, 90, 41, 5, 6, 7, 8, 13, 16, 17, 169/18; 239/222.11, 275, 461, 463, 467, 239/474, 475, 495, 497, 523

See application file for complete search history.

(56) References Cited

U.S. PATENT DOCUMENTS

| | | | |
|---|---|---|---|
| D264,617 | S | 5/1982 | Freeman |
| 4,688,720 | A | 8/1987 | MacDonald et al. |

(Continued)

OTHER PUBLICATIONS

Patent Cooperation Treaty, International Search Report and Written Opinion, Feb. 17, 2009, 8 pages.

*Primary Examiner* — Justin Jonaitis
(74) *Attorney, Agent, or Firm* — Cantor Colburn LLP

(57) ABSTRACT

A nozzle for a fire suppression system has a bonnet and a deflector base. An inlet port extends through the bonnet along the axis of symmetry of the bonnet. The inlet port receives an outlet end of a fire suppression delivery pipe to mount the bonnet to the pipe. The bonnet has a frustoconical surface which extends radially outward and downward from the inlet port. The deflector base is secured to and co-axially aligned with the bonnet at a predetermined distance to create a flow passageway therebetween. The flow passageway imparts a down angle to a suppressant flow discharging from the nozzle to better disperse the suppressant within the fire zone. A discharge port at the circumferential edge of the bonnet and deflector base constricts the suppressant flow to atomize the droplets of liquid suppressant discharged into the fire zone.

18 Claims, 11 Drawing Sheets

(56) References Cited

U.S. PATENT DOCUMENTS

| | | | | |
|---|---|---|---|---|
| 4,967,961 | A * | 11/1990 | Hunter | 239/240 |
| 5,377,798 | A * | 1/1995 | Hudson et al. | 192/58.4 |
| 5,718,381 | A * | 2/1998 | Katzer et al. | 239/222.11 |
| 6,371,212 | B1 * | 4/2002 | Jackson | 169/37 |
| 6,763,894 | B2 * | 7/2004 | Schoenrock et al. | 169/47 |
| 6,843,433 | B1 | 1/2005 | Ryou | |
| 7,090,028 | B2 | 8/2006 | Adiga et al. | |
| 7,153,446 | B2 | 12/2006 | Grigg | |
| 7,232,081 | B2 | 6/2007 | Kah, Jr. et al. | |
| 2003/0075343 | A1 | 4/2003 | Ballard | |
| 2004/0256118 | A1 | 12/2004 | Dunster et al. | |
| 2005/0001065 | A1 * | 1/2005 | Senecal | 239/461 |
| 2007/0034387 | A1 | 2/2007 | Andersen et al. | |
| 2007/0267516 | A1 | 11/2007 | Feith et al. | |

* cited by examiner

ATOMIZING NOZZLE FOR A FIRE SUPPRESSION SYSTEM

BACKGROUND

The present invention relates to fire suppression nozzles in a fire suppression system, and more particularly to an atomizing nozzle for a clean agent fire suppression system.

A "clean agent" system is one of a variety of commercially available fire suppression systems. The term "clean agent" denotes a system that utilizes suppressants which do not leave any residue in the fire zone after discharge. This type of system is ideal for sensitive electronics and/or documents. A typical clean agent system operates by pumping a gas suppressant (such as an inert gas) or a liquid/liquefied gas suppressant agent into the fire zone to inhibit the combustion process of a fire. The gas suppressant suppresses the fire by lowering the level of oxygen in the atmosphere of the fire zone. The reduction in oxygen inhibits combustion and starves the fire. Alternatively, or in addition to starving the fire, the liquid or the vaporizing liquefied-gas suppressant agent may chemically inhibit the combustion process.

Many types of clean agent systems using a variety of suppressants are commercially available. In one particular system, a suppressant agent is liquefied when stored under pressure in a container but is vaporized when released from the container. The suppressant agent is forced from the storage container by an inert gas propellant. The liquefied agent and propellant may form a two phase mixture (gas propellant, gaseous chemical agent, plus liquid chemical agent) in the pipe network of the fire suppression system. This mixture flows through the pipe network until it is discharged through an array of dual fluid nozzles into the fire zone. After discharge into the fire zone, the remainder of the liquefied suppressant agent is vaporized leaving no residue upon evaporation. The vaporized suppressant agent inhibits combustion by carrying heat away from the fire and breaking down the chemical structure of the fire.

In another clean agent system, a liquid suppressant (for example water) or a liquefied-gas suppressant agent is utilized. The liquid or liquefied gas agent is forced through the pipe network of the fire suppression system by a propellant. The propellant and suppressant agent mixture is further combined with additional quantities of a gas (for example an inert gas or Argonite™) in the pipe network of the fire suppression system to provide for total flooding of the fire zone. The mixture of liquid or liquefied gas suppressant, propellant, and gas flows through the pipe network until it is discharged through an array of dual flow nozzles into the fire zone. The suppressant and gas inhibit combustion by absorbing heat and by reducing the amount of oxygen in the atmosphere of the fire zone.

Dual fluid nozzles for clean agent systems such as the nozzle disclosed in United States Patent Application 2005/0001065A1 to Senecal have an internal choke point at or adjacent the nozzle's inlet. Choking the fluid flow internally can allow small droplets formed by the turbulence induced at the choke point to be dissipated when the fluid reforms into a flow sheet prior to discharge from the nozzle. As a result of the reformation of the fluid flow into the flow sheet prior to discharge, the liquid or liquefied suppressant droplets produced by the nozzle have sizes greater than about 20 micrometers (0.79 mils) in diameter upon discharge from the nozzle's outlet. These droplets do not precisely follow the typical conical or radial discharge flow path of the gas suppressant or propellant from the conventional nozzles due to their large momentum. Thus, some of the droplets tend to splash on and adhere to surfaces, such as the walls or the ceiling of the fire zone. Additionally, physical obstacles (such as partitions, desks, tables, or baffles) in the fire zone may obstruct the flow of the droplets, as the droplets may not be able to follow the path of the gas flow around these obstacles. The inability of some of the droplets to flow around obstacles may reduce or eliminate the ability of the fire suppression system to totally flood the fire zone. The result of the wet mist droplets' adherence to surfaces (and the droplets' reduced ability to circulate around obstacles) is that more suppressant agent is required for effective fire suppression, increasing the cost of the clean agent system.

SUMMARY

A nozzle for a fire suppression system has a bonnet and a deflector base. An inlet port extends through the bonnet along the axis of symmetry of the bonnet. The inlet port receives an outlet end of a fire suppression delivery pipe to mount the bonnet to the pipe. The bonnet has a frustoconical surface which extends radially outward and downward from the inlet port. The deflector base is secured to and co-axially aligned with the bonnet at a predetermined distance to create a flow passageway therebetween. The flow passageway imparts a down angle to a suppressant flow discharging from the nozzle to better disperse the suppressant within the fire zone. A discharge port at the circumferential edge of the bonnet and deflector base constricts the suppressant flow to atomize the droplets of liquid suppressant discharged into the fire zone.

DETAILED DESCRIPTION

Figure 1:
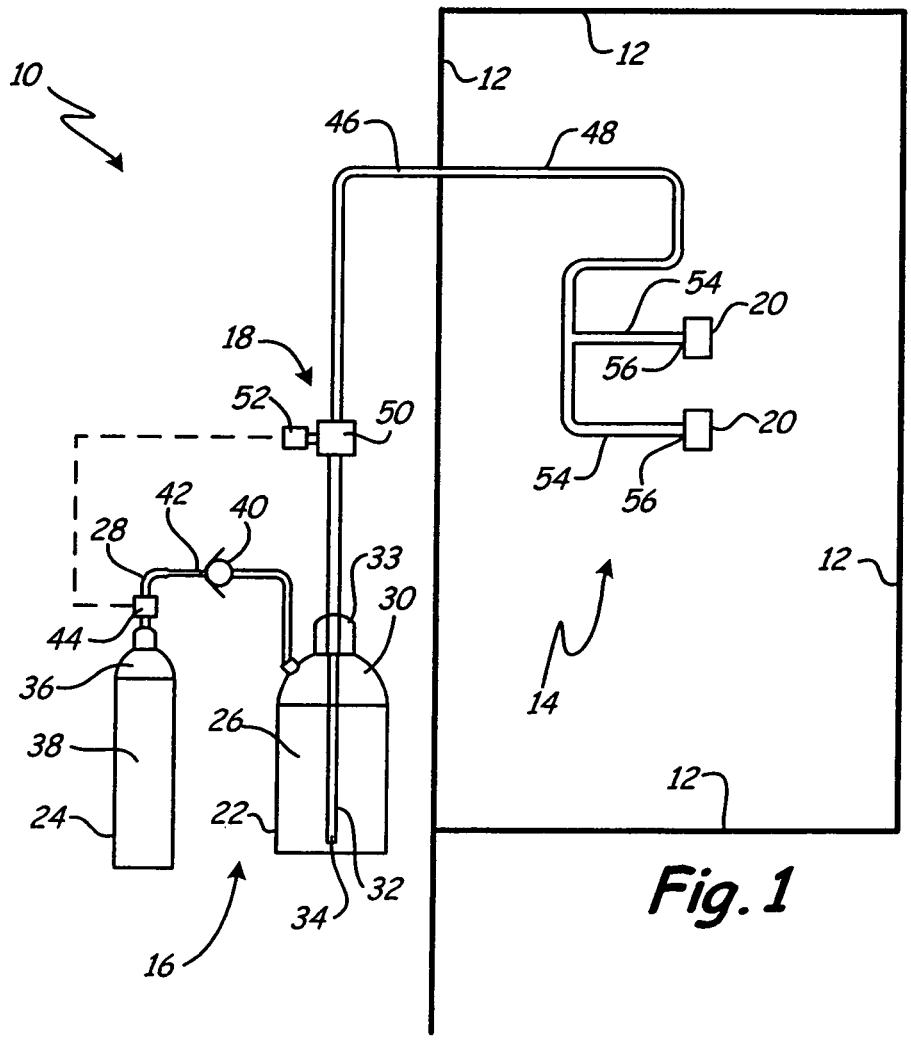
FIG. 1 is a schematic illustration of a clean agent fire suppression system according to one embodiment of the present invention.

FIG. 1 shows a schematic view of one embodiment of a fire suppression system 10. A portion of the fire suppression system 10 enters and extends through a wall, floor or ceiling 12 of a fire zone 14. The fire zone 14 may include virtually any structure, for example, a floor or floors of a building. The main components of the fire suppression system 10 include storage tanks 16, a pipe network 18, and spray nozzles 20.

The storage tanks 16 include a fire suppressant tank 22 and a propellant tank 24. The suppressant tank 22 contains a fire suppressant agent 26, and includes a propellant connecting pipe or hose 28, a fire suppressant agent vapor zone 30, a siphon tube 32, and an outlet port 33. The siphon tube 32 further includes an inlet port 34. The propellant tank 24 includes a propellant gas zone 36 and contains a propellant 38. The propellant connecting pipe 28 further includes a check valve 40, a restriction 42, and an outlet valve 44.

The pipe network 18 includes an input section 46 and an output section 48. The input section 46 includes a valve 50 and a controller 52. The output section 48 includes outlet pipes 54 and outlet ports 56.

FIG. 1 shows the clean agent fire suppression system 10 with all the valves in the system 10 in a closed position. The fire suppression system 10 may be disposed in a building or another suitable structure. A portion of the fire suppression system 10 extends through a wall, a ceiling or floor 12 into the fire zone 14. The fire zone 14 may include any enclosure or building structure. More specifically, the fire suppression system 10 includes pressurized storage tanks 16, which contain a suppressant agent and propellant. The storage tanks 16 may be located in any structure and may be inside or outside of the fire zone 14. In FIG. 1, the storage tanks 16 are disposed outside of the fire zone 14. The pipe network 18 interconnects with the storage tanks 16 and extends into and throughout the fire zone 14. The pipe network 18 terminates at the atomizing spray nozzles 20. The atomizing spray nozzles 20 are capable of spraying a dual flow of the liquefied gas suppressant and the gas propellant into the fire zone 14. The atomizing spray nozzles 20 may be positioned so as to have total flooding capability or local application capability within the fire zone 14. Total flooding capability allows the fire suppression system 10 to suppress a fire in any location within the fire zone 14. If the system 10 uses the local application principle, the nozzles 20 spray suppressant agent directly onto the fire, or into the three dimensional region of the fire zone 14 immediately surrounding the fire.

In FIG. 1, the storage tanks 16 include the fire suppressant tank 22 and the propellant tank 24, interconnected in series. Depending on the requirements the fire suppression system 10 must meet, the series array may be extended to include multiple fire suppressant tanks 22 and multiple propellant tanks 24. The suppressant tank 22 is cylindrical in shape and houses the liquefied-gas fire suppressant 26. A range of different sized commercial cylinders may be used depending on the fire suppression system 10 requirements. Likewise, a variety of suitable commercially available propellant tanks 24 may be used depending on the requirements of the fire suppression system 10.

The liquefied-gas suppressant 26 is generally housed at a gage pressure of between about 0 psi and about 100 psi (about 0 MPa to about 0.69 MPa), when a temperature of about 77° F. (25° C.) is maintained. In one embodiment, the fire suppression system 10 uses 1,1,1,2,3,3,3-heptafluoropropane (CF3CHFCF3), also known as "HFC-227ea," as the fire suppressant 26. HFC-227ea has a boiling point below that of a typical room temperature (77° F. or 25° C.), such that it normally assumes a gaseous state at room temperature. This allows HFC-227ea to inhibit combustion by carrying heat away from the fire and breaking down the chemical structure of the fire. In other embodiments, the liquefied-gas suppressant 26 may include: Novec™ 1230 (CF3CF2C(O)CF(CF3)2), trifluoromethane, trifluoroiodomethane, hydrofluourocarbons, perfluorocarbons, hydroclorofluorocarbons, or any other suitable liquefied-gas that acts as a fire suppressant.

The propellant connecting pipe or hose 28 connects the propellant tank 24 to the fire suppressant tank 22. This interconnection may occur in the fire suppressant agent vapor zone 30 in the upper portion of the fire suppressant tank 22. This interconnection arrangement allows a propellant force to be exerted on the liquefied-gas suppressant 26, to drive the liquefied suppressant 26 up through the siphon tube 32 in the fire suppressant tank 22 and out through the outlet port 33 to the pipe network 18. More specifically, the liquefied suppressant 26 enters the siphon tube 32 through the inlet port 34, which is disposed adjacent the bottom of the fire suppressant tank 22. The disposition of the inlet port 34 in the liquefied portion of the fire suppressant 26 allows the fire suppressant 26 to be pushed into the pipe network 18 in compressed liquefied form. In another embodiment, the siphon tube 32 is eliminated and the outlet port 33 of the fire suppressant tank 22 is disposed at or near the bottom of the tank 22. This allows the fire suppressant 26 to be pushed into the pipe network 18 in compressed liquid form.

The propellant connecting pipe 28 also connects to the vapor gas zone 36 at the top portion of the propellant tank 24. The liquid propellant 38 in the lower portion of the propellant tank 24 may be a non-condensable gas, such as nitrogen, argon, Argonite™ (a mixture of 50 percent by weight argon and 50 percent by weight nitrogen), or another suitable gas, which has a lower boiling point than the fire suppressant 26. Alternatively, the propellant 38 may be a liquefied compressed gas, such as carbon dioxide or another suitable gas, which also has a lower boiling point than the fire suppressant 26. This lower boiling point provides a large gas pressure for propelling the fire suppressant 26 through the siphon tube 32 and the pipe network 18. The gas propellant 38 is selected because of its non-combustible properties and its low boiling point.

In FIG. 1, the check valve 40 is disposed in the propellant connecting pipe 28. When open, the check valve 40 allows gas propellant 38 to flow through the connecting pipe 28 between the zones 30, 36. The check valve 40 may also be opened to provide for pressure release of the fire suppression system 10. When closed, the check valve 40 prevents reverse flow through the connecting pipe 28 from the fire suppressant agent vapor zone 30 to the vapor gas zone 36.

The rate of flow of propellant 38 through the connecting pipe 28 may be limited by the restriction 42 upstream of the check valve 40. In one embodiment, the restriction 42 is located at the inlet of the check valve 40. The cross sectional area of the restriction 42 provides the fire suppressant tank 22 with a specified flow rate of gas propellant 38. The specified flow rate of the gas propellant 38 results in a specific predetermined pressure being exerted on the fire suppressant 26. As a result of the specific pressure of the propellant 38, a specific flow rate and pressure is achieved as the fire suppressant 26 (or mixture of suppressant 26 and propellant 38) flows through the pipe network 18. The size and location of the restriction 42 may vary and is selected depending on the requirements of the fire suppression system 10.

The outlet valve 44 is disposed further upstream from the restriction 42. The outlet valve 44 may be located on the connecting pipe 28 or the propellant tank 24, and is capable of an "on" or "off" setting. In one embodiment, when the fire suppression system 10 is not in use, the outlet valve 44 is set to the off position. In the off position, the outlet valve 44 is closed, such that there is no mixing of the gas propellant 38 with the fire suppressant 26. In another embodiment, when the outlet valve 44 is set to the off position the outlet valve is only partially closed. This allows some gas propellant 38 to enter the propellant tank 24 and mix with, and dissolve in the fire suppressant 26 if so required. The gas propellant 38 thereby maintains a pressure load on the fire suppressant 26. The outlet valve 44 may be provided with a sensor or a control which switches or activates the outlet valve 44 to the "on" setting when a fire is detected in the fire zone 14. In the "on" setting, the outlet valve 44 is fully opened and the propellant 38 flows through the connecting pipe 28.

In FIG. 1, the fire suppressant tank 22, the propellant tank 24, and the propellant connecting pipe 28 are configured such that when the outlet valve 44 is opened, only gas propellant 38 enters the fire suppressant tank 22. By allowing only gaseous propellant 38 to enter the suppressant tank 22, little mixing or dissolving of propellant 38 into the liquefied-gas fire suppressant 26 occurs. As gas propellant 38 enters the fire suppressant tank 22, the liquid fire suppressant 26 is pushed out of the outlet port 33 of the propellant tank 24 into the input section 46 and the output section 48 of the pipe network 18. Thus, by maintaining a high enough pressure on the fire suppressant 26 to prevent the propellant 38 from dissolving in the liquefied-gas fire suppressant 26, the fire suppressant 26 may be configured to maintain a single phase liquid even through the pipe network 18. In this embodiment, most of the gas propellant 38 remains in the fire suppressant tank 22 after displacing the liquefied-gas fire suppressant 26.

In another embodiment, the system 10 may be configured to allow the gas propellant 38 to mix with and dissolve in the liquefied-gas fire suppressant 26. Thus, a two phase liquid is pushed through the pipe network 18. The nozzles 20 are capable of atomizing the flow resulting from either embodiment.

The valve 50 is disposed in the input section 46 downstream of the suppressant tank 22. The valve 50 arrests the flow from the suppressant tank 22 when the valve is in an "off" position. When a fire is detected in the fire zone 14, the valve 50 is opened by the controller 52. The controller 52 may be either manually or automatically activated. The valve 50 may be linked to the outlet valve 44 such that both valves are simultaneously activated by the controller 52. Alternatively, outlet valve 44 may be opened before valve 50 such that the pressure buildup upstream of valve 50 opens the valve 50.

After the valve 50 is opened, the suppressant 26 (or the mixture of suppressant 26 and propellant 38) flows through the remainder of the input section 46 and the output section 48 to the nozzles 20. More specifically, the output section 48 of the pipe network 18 passes through the wall, ceiling or floor 12 to enter and extend throughout the fire zone 14. The output section 48 may extend through multiple structures 12 (such as walls, ceilings, or floors) in the case of a multi-story fire zone 14. Multiple outlet pipes 54 having threaded pipe end 56 sections diverge from the output section 48 into different parts of the fire zone 14. The nozzles 20 are adapted to secure to the outlet ports 56. The suppressant 26 or the mixture of suppressant 26 and propellant 38 flows through the pipe end 56 into the nozzle 20 where it is atomized and sprayed into the fire zone 14.

Figure 2:
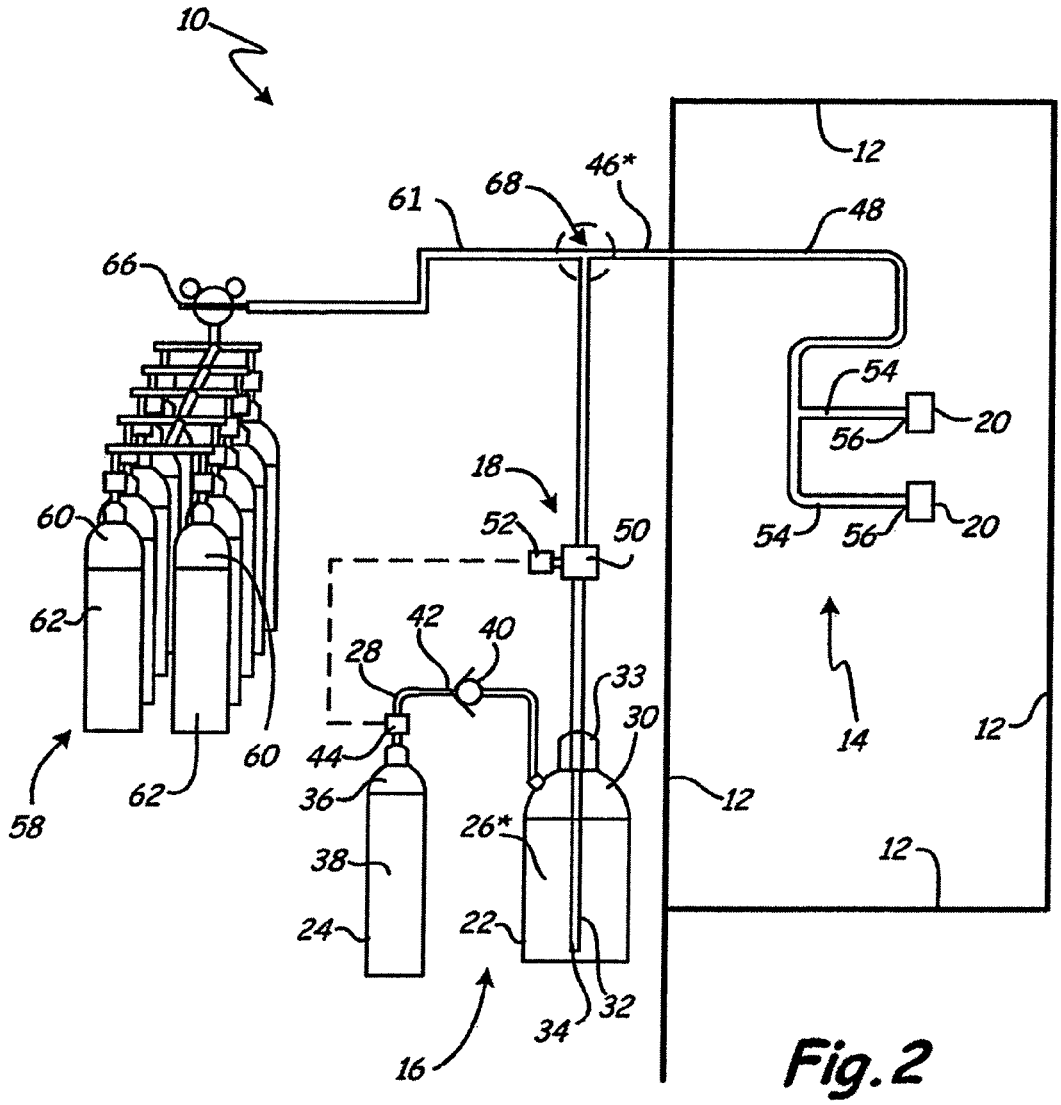
FIG. 2 is a schematic illustration of another embodiment of the clean agent fire suppression system.

FIG. 2 shows another embodiment of the clean agent fire suppression system 10. In addition to the components from the embodiment shown in FIG. 1, this embodiment includes tanks 58. The tanks 58 further include vapor gas zones 60 and contain a second suppressant 62. The second input section 60 includes an outlet valve 66 and a junction 68.

The tanks 58 include multiple cylinders interconnected in fluid series. The number and size of the tanks 58 may be varied depending on the system 10 requirements. In one embodiment, model number 90-102300-001 from Kidde Fire Systems (having a fill capacity of 12.4 MPa at 21 degrees Celsius) is used in the fire suppression system 10. The tanks 58 interconnect in the vapor gas zones 60 toward the top portion of each tank 58.

The suppressant 62 in the tanks 58 may be a non-condensable gas, such as nitrogen, argon, Argonite™, or another suitable gas such as another inert gas. Alternatively, the suppressant 62 may be a liquefied compressed gas, such as carbon dioxide or another suitable gas. The gas suppressant 62 reduces the concentration of oxygen in the fire zone 14.

The flow of suppressant 62 through the second input section 61 is regulated by the outlet valve 66, which may be located on the input section 61 of the pipe network 18 or the tanks 58 themselves. The outlet valve 66 is capable of an "on" or "off" setting. When the fire suppression system 10 is not being utilized, the outlet valve 66 is set to the "off" position. In the off position, the outlet valve 66 is closed such that no suppressant 62 enters the fire zone 14. The outlet valve 66 may be provided with a sensor or a control which switches or activates the outlet valve 66 to the "on" setting when a fire is detected in the fire zone 14. In the "on" setting, the outlet valve 66 is fully opened and suppressant 62 flows through the input section 61.

In addition to the fire suppressant agents 26 discussed in the system 10 shown in FIG. 1, the system 10 shown in FIG. 2 may utilize additional suppressant agent(s) 26* such as a liquid(s) with high heat(s) of vaporization and/or liquid(s) that have relatively inert molecular structures. For example, water ($H_2O$) may be used as the suppressant agent 26* with the embodiment of the fire suppression system 10 shown in FIG. 2. Distilled water or another liquid that is electrically non-conducting and does not leave a residue upon evaporation may be suppressant agent(s) 26* in the fire suppression system 10. Thus, when there is a fire in the fire zone 14 and the valve 50 is opened, the liquid suppressant 26* (or mixture of suppressant 26* and propellant 38) flows through the remainder of the input section 46 to the junction 68. At the junction 68, the liquid suppressant 26* and the gas suppressant 64 are mixed to form a two phase liquid and gas mixture in the input section 46* before being atomized and sprayed through the dual flow nozzles 20 into the fire zone 14. The valve 50 may be linked to the outlet valve 66 as well as the outlet valve 44 such that all three valves are simultaneously activated by the controller 52.

Figure 3A:
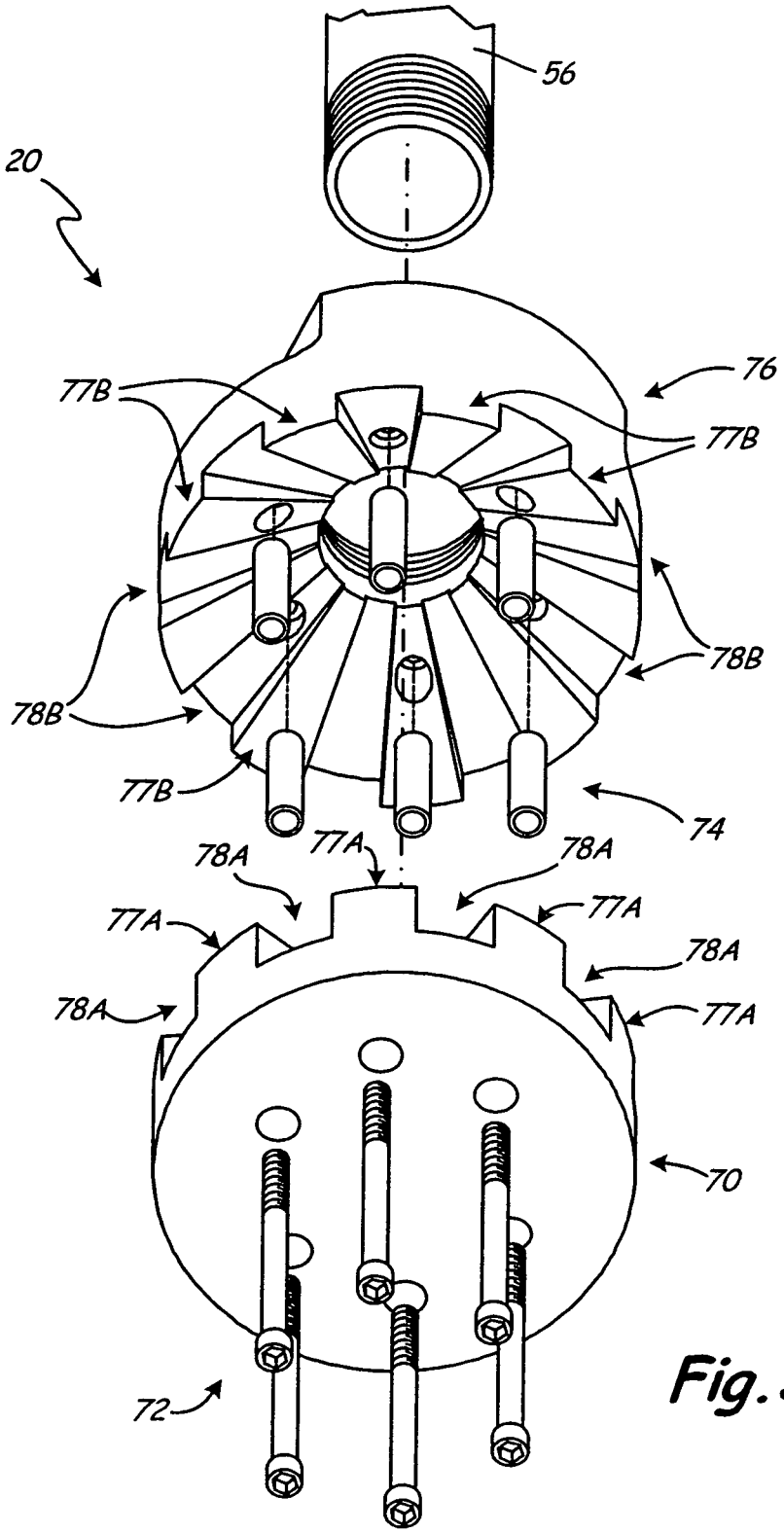
FIG. 3A is an exploded perspective assembly view of one embodiment of a nozzle and an outlet port of the system from FIG. 1 or FIG. 2.
Figure 3B:
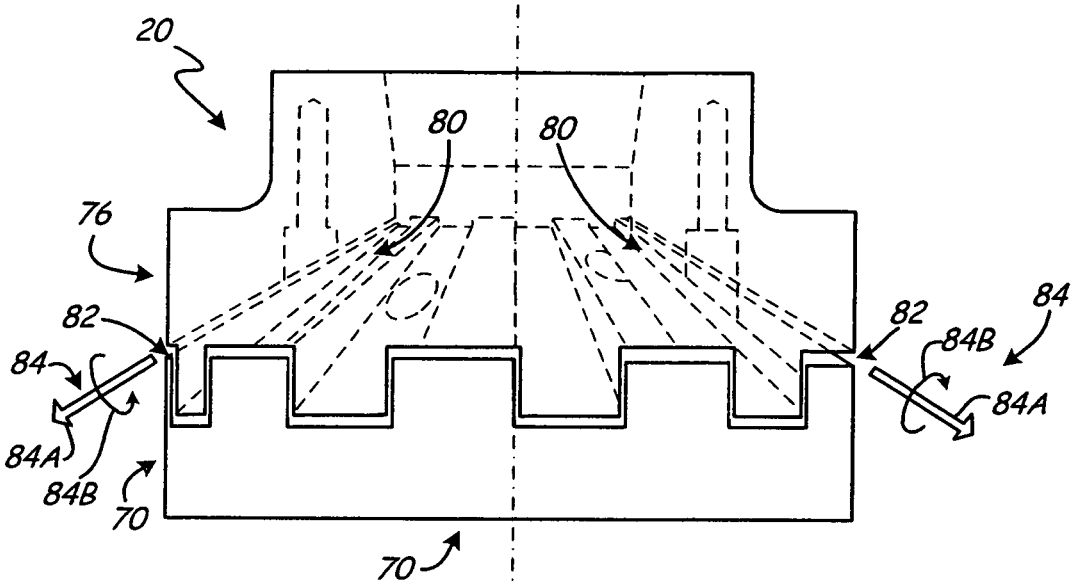
FIG. 3B is a side view of one embodiment of the nozzle from FIG. 3A as assembled.

FIG. 3A shows an exploded perspective view of one embodiment of the nozzle 20 disposed below the pipe end 56. FIG. 3B shows a side view of the assembled nozzle 20. The nozzle 20 includes a deflector base 70, fasteners 72, spacers 74, and a bonnet 76. The deflector base 70 includes lands 77A and channels 78A. The bonnet 76 includes lands 77B and channels 78B. Together the spaced apart disposition of the deflector base 70 and bonnet 76 define a flow passageway 80 and a discharge port 82.

The nozzle 20 may be constructed from any suitable metallic, polymeric, ceramic or composite material. In FIGS. 3A and 3B, the deflector base 70 has a generally frustroconical shape. The deflector base 70 receives the fasteners 72 and spacers 74, which interconnect the deflector base 70 co-axially to the bonnet 76 at a spaced apart distance. The deflector base 70 has a generally convex upper surface which interfaces the generally concave lower surface of the bonnet 76. The upper surface of the deflector base 70 has circumferentially alternating lands 77A and channels 78A. The lower surface of the bonnet 76 has circumferentially alternating lands 77B and channels 78B. When the nozzle 20 is assembled, the lands 77A on the deflector base 70 extend into the channels 78B in the bonnet 76 and the channels 78A in the deflector base 70 receive the lands 77B on the bonnet 76.

The bonnet 70 receives the threaded pipe end 56 of the outlet pipes 54 (FIGS. 1 and 2) and may be adapted to abut a surface such as a ceiling or wall. The fasteners 72 and spacers 74 secure the deflector base 70 to the bonnet 76 and hold the deflector base 70 off the bonnet 76 at a predetermined distance. This distance creates the flow passageway 80 between the top surface of the deflector base 70 and the bottom surface of the bonnet 76. More particularly, the flow passageway 80 is formed between the lands 77A, 77B and channels 78A, 78B of the deflector base 70 and the bonnet 76. The flow passageway 80 formed between these features allows the suppressant discharged from the pipe end 56 to flow to the outer edge of the nozzle 20.

FIGS. 3A and 3B illustrate the upper portion of the flow passageway 80 which is defined by the frustoconically shaped lower surface of the bonnet 76. This surface of the bonnet 76 gives the suppressant within the flow passageway 80 (and upon discharge from the nozzle 20) a "down angle" with respect to the axis of symmetry of the bonnet 76. Likewise, the deflector base 70 may be adapted to impart a down angle to the suppressant within the flow passageway 80. The down angle the lands 77A impart to the suppressant may be the same as or different from the down angle the lands 77B impart to the suppressant. Similarly, the channels 78A in the deflector base 70 and the channels 78B in the bonnet 76 can impart various down angles to the suppressant.

The small distance the deflector base 70 is spaced off the bonnet 76 (coupled with the different down angles of the lands 77A and channels 78A of the deflector base 70 with respect to the down angles of the lands 77B and channels 78B of the bonnet 76 in some embodiments) creates a small discharge port 82 along the circumferential outer edge of the deflector base 70 and bonnet 76. More specifically, the discharge port 82 is defined by the distance between the top surface of the deflector base 70 and the bottom surface of the bonnet 76 at the edge of each of those components. The desired discharge port 82 area (and hence height) will vary with fire suppression system operating conditions and can be approximated by the equation:

$$\dot{m}_{max} = AP_0\sqrt{\frac{k}{RT_0}}\left(\frac{2}{k+1}\right)^{(k+1)/[2(k-1)]}$$

where: $\dot{m}_{max}$ is the maximum mass flow rate of the gas; A is the minimum cross-sectional flow area where the flow is choked; k is the specific heat ratio; R is the universal gas constant; $P_0$ is the stagnation pressure; $T_0$ is the stagnation temperature.

In one embodiment, the distance between the deflector base 70 and bonnet 76 at the discharge port 82 is between about 100 micrometers to about 200 micrometers (about 4/1000 inch to about 8/1000 inch).

Thus, the disposition of the deflector base 70 with respect to the bonnet 76 along with the geometric characteristics (the various down angles and interleaved disposition of the lands 77A, 77B and channels 78A, 78B) of the deflector base 70 and bonnet 76 determine the size and shape of the flow passageway 80 and discharge port 82. The discharge port 82 functions to choke the flow of the suppressant in the flow passageway 80 and shear the liquid or liquefied-gas (from hereon, any reference to liquid in this specification also encompasses liquefied-gas) suppressant in the liquid/gas flow mixture (via propagated shock waves) at the discharge port 82 to atomize (create liquid droplets smaller than about 10 micrometers (0.39 mils)) the suppressant droplets in the discharge suppressant flow 84 which leaves the nozzle 20 and enters the fire zone. The shear produced at the discharge port 82 is the result of the discrepancy between the velocity of the suppressant flow (which is discharged at or near the speed of sound) and the velocity of the air in the fire zone. Thus, the small size of the discharge port 82 is capable of producing liquid suppressant droplets smaller than about 10 micrometers (0.79 mils). These small atomized droplets vaporize rapidly to release the liquefied gas suppressant agent to the atmosphere of the fire zone.

Similarly, the disposition of the deflector base 70 with respect to the bonnet 76 along with the geometric characteristics (the various down angles and interleaved disposition of the lands 77A, 77B and channels 78A, 78B) of the deflector base 70 and bonnet 76 also cause two types of flow perturbations 84A and 84B (the significance of each perturbation will be addressed subsequently in this specification) which determine the direction (and ultimately the distribution and dispersion) of the atomized suppressant flow 84 discharged into the fire zone. Both types of flow perturbations 84A and 84B are effective for creating droplet distribution and dispersion in the fire zone because the atomized droplets (less than about 10 micrometers) leaving the discharge outlet 82 better follow the general path (a general path which is determined by the aforementioned geometric characteristics of the nozzle 20) of the gas suppressant 64 or vaporized suppressant 26 or 26* (FIGS. 1 and 2) than larger droplets due to the smaller momentum of the small atomized droplets. The improved ability of the atomized droplets to follow the path of the gas suppressant 64 or vaporized suppressant 26 or 26* (FIGS. 1 and 2), coupled with the ability of the nozzle 20 to direct the discharge flow via down angles and interleaved lands 77A, 77B and channels 78A, 78B, allows the liquid suppressant droplets to more freely circulate around obstacles in the fire zone, thus improving the ability of the fire suppression system to flood the fire zone.

Figure 3C:
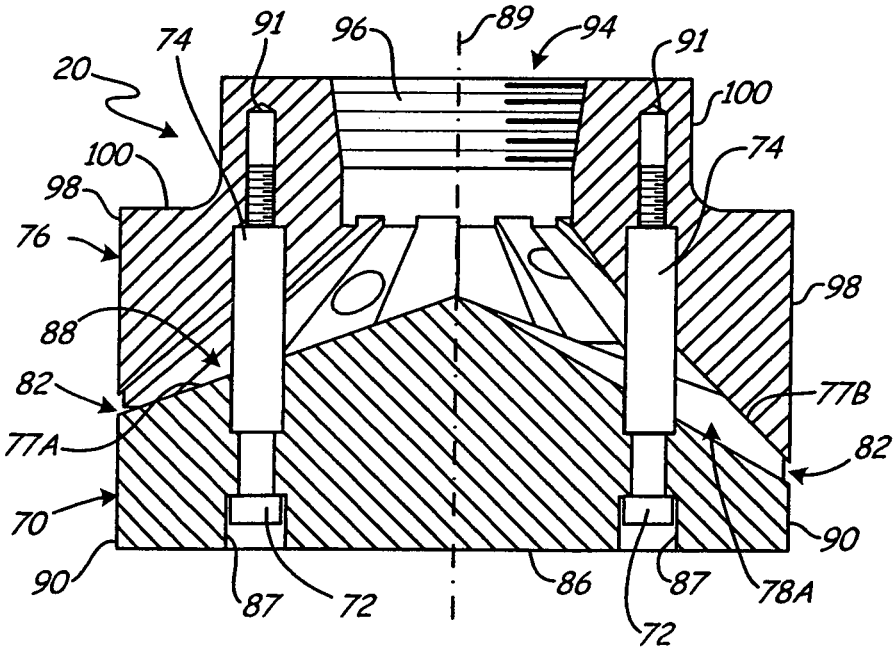
FIG. 3C is a cross sectional side view of the nozzle from FIG. 3B.

FIGS. 3B and 3C illustrate the assembled nozzle 20. Specifically, FIG. 3C shows a cross sectional view of the nozzle 20. The deflector base 70 includes a bottom surface 86, thru holes 87, a top convex surface 88, an axis 89, and a side surface 90. The bonnet 76 includes counter bore holes 91, a concave surface 92, an inlet port 94, threads 96, a side surface 98, and a top surface 100. In FIG. 3B, the nozzle 20 is shown discharging suppressant with two types of flow perturbations 84A and 84B. The first flow perturbation is a down angle flow 84A. The second flow perturbation is a streamwise vorticity suppressant flow 84B.

In FIG. 3C, the bottom surface 86 of the deflector base 70 is generally flat and cylindrical in shape. Six thru holes 87 extend through the deflector base 70 from the bottom surface 86 to the top convex surface 88 or to one of the channels 78. The thru holes 87 have a counter bore portion which extends upward from the bottom surface. The thru holes 87 are adapted to receive the fasteners 72, which are inserted into the deflector base 70 from the bottom such that the head of the fasteners 72 contact the counter bore. The thru holes 87 also have a counter bore portion which extends downward from the top convex surface 88 or from the channels 78A. This counter bore receives the spacers 74, which surround the fasteners 72. The top convex surface 88 extends radially outward from the axis 89. The top convex surface 88 has circumferentially alternating lands 77A and channels 78A. In one embodiment, the top convex surface 88 slopes downward and radially outward from the axis 89 to the side surface 90. The angle of the top convex surface 88 with respect to the axis 89 or the angle of the channels 78 with respect to the axis 89 may vary in different embodiments. The channels 78A extend into the top convex surface 88 while the lands 77A project therefrom. The side surface 90 extends circumferentially downward from the top convex surface 88 to the bottom surface 86.

The fasteners 72 extend upward through the deflector base 70 and through the spacers 74 and are received by the counter bore holes 91 in the bonnet 76. The counter bore holes extend upwards into the bonnet 76 from the concave surface 92 or from the channels 78. The lower portion of the counter bore holes 91 receive the spacers 74, which contact the bottom of the counter bore. The upper portion of the counter bore holes 91 may be tapped to thread with the fasteners 72, which secures the deflector base 72 to the bonnet 76.

The concave surface 92 extends outward and downward from the inlet port 94. The concave surface 92 has circumferentially alternating lands 77B and channels 78B. The lands 77B project from the concave surface 92 and the channels 78B extend into the concave surface 92. The down angle of the lands 77B and channels 78B (with respect to the axis 89) may vary from embodiment to embodiment. The inlet port 94 extends symmetrically through the bonnet 76, and generally aligns vertically with the axis of symmetry 89 on the deflector base 70. The sides of the inlet port 94 are threaded to secure to the pipe end 56. The concave surface 92 extends radially outward and downward to the side surface 98. The side surface 98 is circumferential in shape and extends from the flow surface 92 to the top surface 100. The top surface 100 extends upward and has a portion adapted with the inlet port 94 extending therethrough. The top surface 100 may abut a surface such as a ceiling or wall when the nozzle 20 is installed in the fire zone.

The threads on the pipe end 56 of the pipe network 18 (FIGS. 1 and 2) are adapted to receive the threads 96 in the bonnet 76, to mount the bonnet 76 (and the remainder of the nozzle 20) to the pipe network 18. The inlet port 94 receives the discharge flow of gas and liquid suppressant 26, or 26*, and/or 64 from the pipe end 56 (FIGS. 1 and 2).

In the embodiment shown, the channels 78A and lands 77A are wedge shaped and extend into or project from the deflector base 70. Likewise, the channels 78B and lands 77B are wedge shaped and extend into or project from the bonnet 76. Each channel 78A and 78B gets wider and deeper (with respect to the top convex surface 88 or concave surface 92) as it extends radially outward from the adjacent the axis 89 to the discharge port 82 at the side surfaces 90 or 98. Each channel 78A, 78B or land 77A, 77B (or a group of channels 78A, 78B or lands 77A, 77B) may have a down angle that differs from that of the other channels 78A, 78B or lands 77A, 77B (or groups of channels 78A, 78B or lands 77A, 77B) in the deflector base 70 or the bonnet 76.

When the deflector base 70 is disposed below the bonnet 76 in an assembled position as illustrated in FIG. 3B, the top convex surface 88 interfaces with the concave surface 92 such that the lands 77A extend into the channels 78B and the lands 77B extend into the channels 78A. In one embodiment, the similar down angles and interleaved arrangement of the lands 77A, 77B and channels 78A, 78B allow the flow passageway 80 and discharge port 82 to be substantially spatially uniform around the circumference of the nozzle 20.

As illustrated in FIG. 3B, the flow passageway 80 extends downward and radially outward from the axis 89 and is defined between the lands 77A, 77B and channels 78A, 78B. The flow passageway 80 extends circumferentially 360 degrees about the axis 89. In other embodiments, the flow passageway 80 may extend circumferentially about the axis 89 to angles which total less than 360 degrees or may include multiple distinct flow passageways because a portion(s) of the deflector base 70 interconnects directly with a portion(s) of the bonnet 76. The flow passageway 80 may have a constant or decreasing height and width depending upon the disposition, size, alignment, and down angle of the lands 77A, 77B and channels 78A, 78B with respect to one another.

The bottom outer portion of the flow passageway 80 becomes the discharge port 82 at the side surfaces 90 and 98 of the deflector base 70 and the bonnet 76. The discharge port 82 extends circumferentially around the nozzle 20 and is defined by the space between the deflector base 70 and bonnet 76 at each features edge. In the embodiment shown, a substantially constant discharge port 82 size (height and width) is maintained around the entire circumference of the nozzle 20. Alternatively, the discharge port 82 may vary in size around the circumference of the nozzle 20 or extend only through portions of the side surfaces 90 and 98. In one embodiment, the stand-off height of the discharge port 82 is between about 100 micrometers to about 200 micrometers (about 4/1000 inch to about 8/1000 inch). As indicated previously, the relatively small size of the discharge port 82 functions to choke the flow of the suppressant in the flow passageway 80 and shear the liquid suppressant in the liquid/gas flow mixture (via propagated shock waves) at the discharge port 82 to atomize (create liquid droplets smaller than about 10 micrometers (0.39 mils)) the liquid suppressant droplets in the discharge suppressant flow 84 which leaves the nozzle 20 and enters the fire zone. The shear produced at the discharge port 82 is the result of the discrepancy between the velocity of the suppressant flow (which is discharged at or near the speed of sound) and the velocity of the air in the fire zone.

The down angles of the features which define the flow passageway 80 direct the suppressant flow radially outward and downward through the flow passageway 80 and out through the discharge port 82. The down angle of the suppressant flow in the flow passageway 80 is correlated to the direction of the down angle flow 84A upon exiting the discharge port 82. Thus, the down angles of the interleaved lands 77A, 77B and channels 78A, 78B with respect to the axis 89 are responsible for generating the first flow perturbation, the down angle flow 84A. The direction of the down angle flow 84A away from the surface (such as a wall or ceiling) from which the nozzle 20 extends reduces the chances that the suppressant flow will impinge or attach to that surface. Thus, with the down angle flow 84A greater dispersion and disbursement of liquid suppressant in the fire zone may be achieved. Alternatively, the features which define the flow passageway 80 may be given steep down angles such that the resulting down angle flow 84A is directed downward to a particular localized location in the fire zone.

The second flow perturbation, the streamwise vorticity suppressant flow 84B, is the result of the interleaved lands 77A, 77B and channels 78A, 78B of the bonnet 76 and the deflector base 70. The geometry of the channels 78, specifically the channel edges which extend along the entire radial length of the channels 78, create a discontinuity or segmentation in the flow in the flow passageway 80. Instead of flowing outward in the flow passageway 80 as a uniform sheet, the discharge flow encounters a slight obstruction at the edges of each of the channels 78A and 78B. The result of this obstruction is a discrepancy between the velocity of the flow at the edges of the channels 78A and 78B and the velocity of the flow in the central portions of the channels 78A and 78B. The resulting velocity gradient causes a portion of the discharge suppressant flow 84 adjacent the edges of the channels 78A and 78B to rotate or roll up upon itself as the flow 84 exits the discharge port 82. The direction of the rolling of the streamwise vorticity suppressant flow 84B is a vector perpendicular to the orientation of the discharge port 82. Each channel 78 generates multiple streamwise vorticity suppressant flows 84B along each edge which propagate outward generally along the path of the remainder of the discharge suppressant flow 84 (for example along the path of the down angle flow 84A). The rotating streamwise vorticity suppressant flows 84B are effective for introducing turbulence into the discharge suppressant flow 84 to help augment mixing of the small droplets with the gas suppressant 64 or vaporized suppressant 26 or 26* (FIGS. 1 and 2). The disbursed droplets can follow the flow of the gas suppressant 64 or vaporized suppressant 26 or 26* The streamwise vorticity suppressant flow 84B generated by the nozzle 20 breaks up the discharge suppressant flow 84 thereby minimizing the adherence of the droplets to obstacles (such as the ceiling) in the fire zone.

Figure 3D:
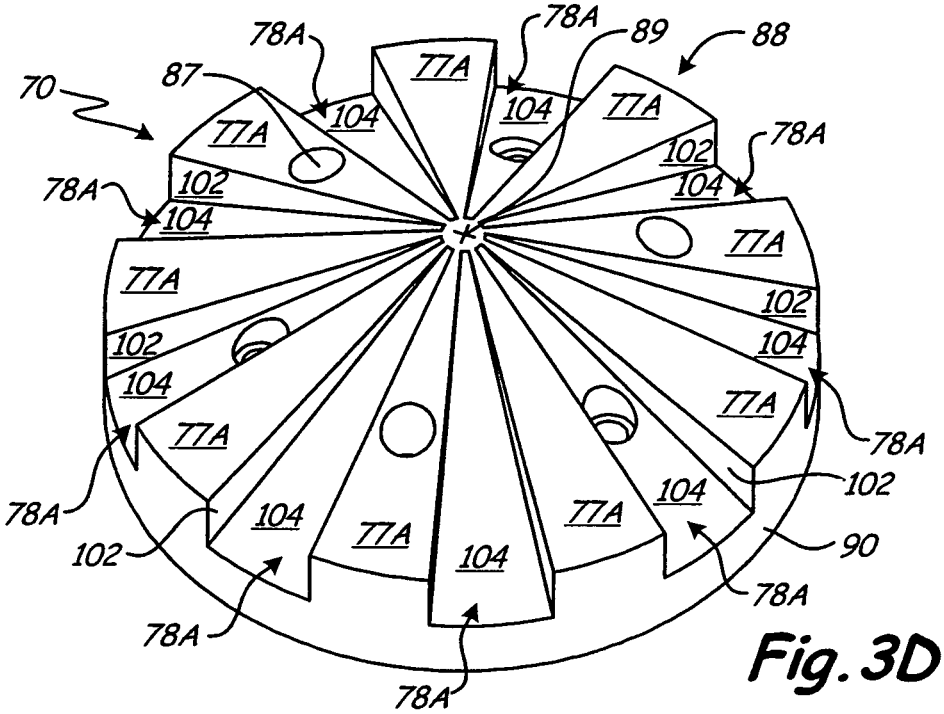
FIG. 3D is a top perspective view of a deflector base from the nozzle of FIG. 3A.
Figure 3E:
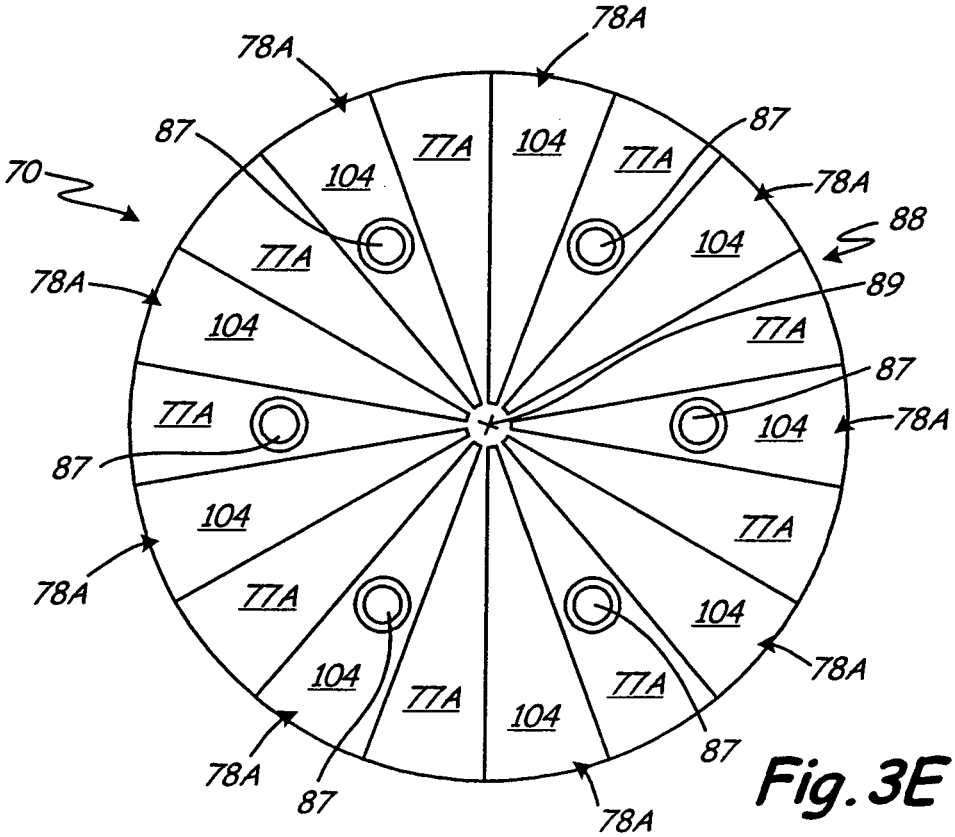
FIG. 3E is a top view of the deflector base from FIG. 3D.
Figure 3F:
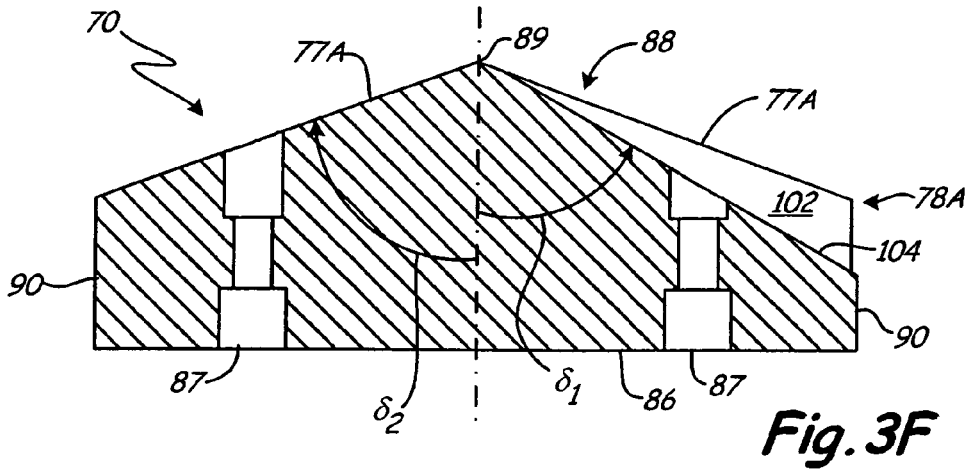
FIG. 3F is a sectional view of the deflector base from FIG. 3D.

FIG. 3D to FIG. 3F show the deflector base 70 from various perspectives. In FIGS. 3D to 3F, the channels 78A extend into the top convex surface 88 and the lands 77A project from the top convex surface 88. Each channel 78A includes side surfaces 102 and a base surface 104. Each channel 78A has two side surfaces 102, which taper radially inward toward each other (and toward the axis 89) from the side surface 90. The tapering of the side surfaces 102 gives each channel 78A and each land 77A a wedge shaped appearance. The side surfaces 102 interconnect at a generally perpendicular angle with the base surface 104 which extends between the side surfaces 102. In another embodiment, one or both of the side surfaces 102 may interconnect with the base surface 104 at an angle other than a generally perpendicular angle.

As shown in FIG. 3F, the channels 78A have a down angle $\delta_1$ (measured from the base surface 104) which differs from the down angle $\delta_2$ of the lands 77A. The down angles $\delta_1$ and $\delta_2$ are measured with respect to the axis 89. The down angle $\delta_1$ of each of the channels 78A may differ and need not be the same for each channel 78A. In the embodiment of the deflector base 70 shown, the down angle $\delta_1$ of the channels 78A (measured from the base surface 104) differs from the down angle $\delta_2$ of the lands 77A such that the depth of each channel 78A decreases as the channel 78A extends radially inward toward the axis 89. The thru holes 87 are arrayed such that several holes 87 are disposed in the channels 78A, while other holes 82 are disposed in the lands 77A. The depth of the counter bore in the top portion of each of the thru holes 87 will vary depending on whether the thru hole 87 passes through the channels 78A or the lands 77A.

Figure 3G:
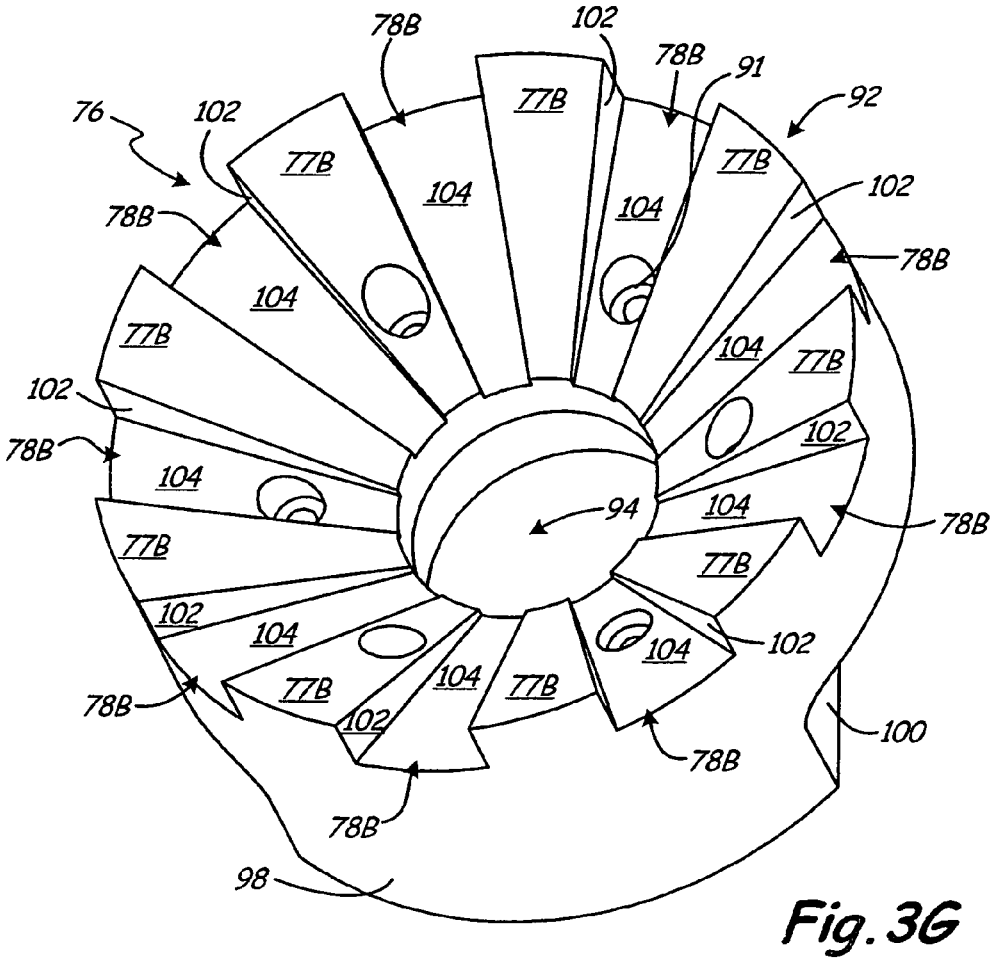
FIG. 3G is a bottom perspective view of a bonnet from the nozzle of FIG. 3A.
Figure 3H:
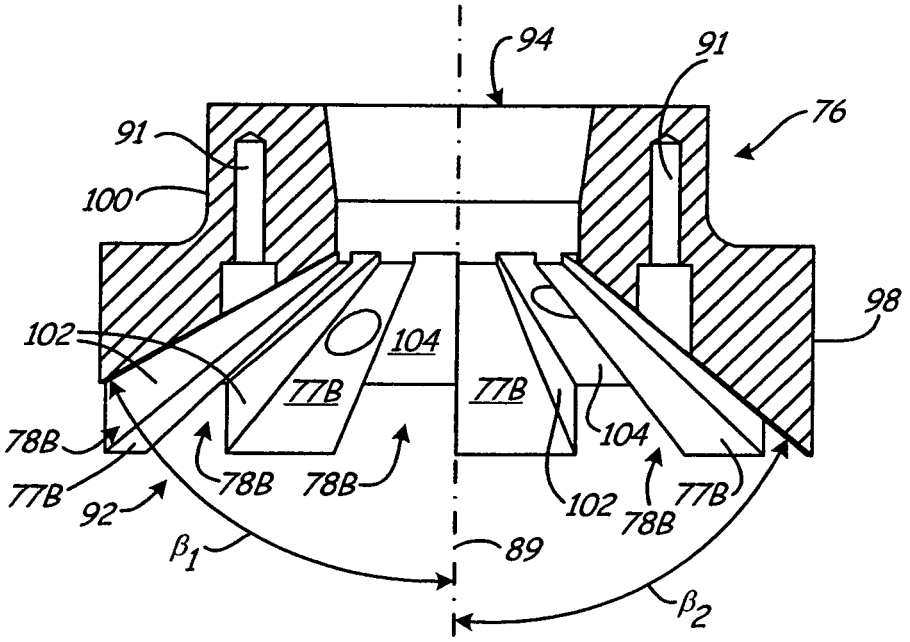
FIG. 3H is a sectional view of the bonnet from FIG. 3G.

FIGS. 3G to 3H show the bonnet 76 from various perspectives. The channels 78B extend into the concave surface 92 and extend radially from the side surface 98 to the inlet port 94. The lands 77B project from the concave surface 92 and extend radially from the side surface 98 to the inlet port 94. Similar to the channels 78A in the deflector base 70, the channels 78B in the bonnet 76 include side surfaces 102 and the base surface 104. Each channel 78B has two side surfaces 102, which taper radially inward from the side surface 98 to the inlet port 94 to give each channel 78B and each land 77B a truncated wedge shape.

As shown in FIG. 3I, the channels 78B have a down angle $\beta_1$ (measured from the base surface 104) which differs from the down angle $\beta_2$ of the lands 77B. The down angles $\beta_1$ and $\beta_2$ are measured with respect to the axis 89. Similar to the channels 78A in the deflector base 70, the down angle $\beta_1$ of each of the channels 78B may differ and need not be the same for each channel 78B. The down angles $\beta_1$ and $\beta_2$ may differ from the down angles $\delta_1$ and $\delta_2$ (FIGS. 3D to 3F). In the embodiment of the bonnet 76 shown, the down angle $\beta_1$ of the channels 78B (measured from the base surface 104) differs from the down angle $\beta_2$ of the lands 77B such that the depth of each channel 78B decreases as the channel 78B extends radially inward toward the axis 89. The counter bore holes 91 are arrayed such that several holes 91 are disposed in the channels 78B, while other holes 91 are disposed in the lands 77B. The depth of the counter bore in the lower portion of each of the holes 91 will vary depending on whether the hole 91 is disposed in the channels 78B or the lands 77B.

Figure 4A:
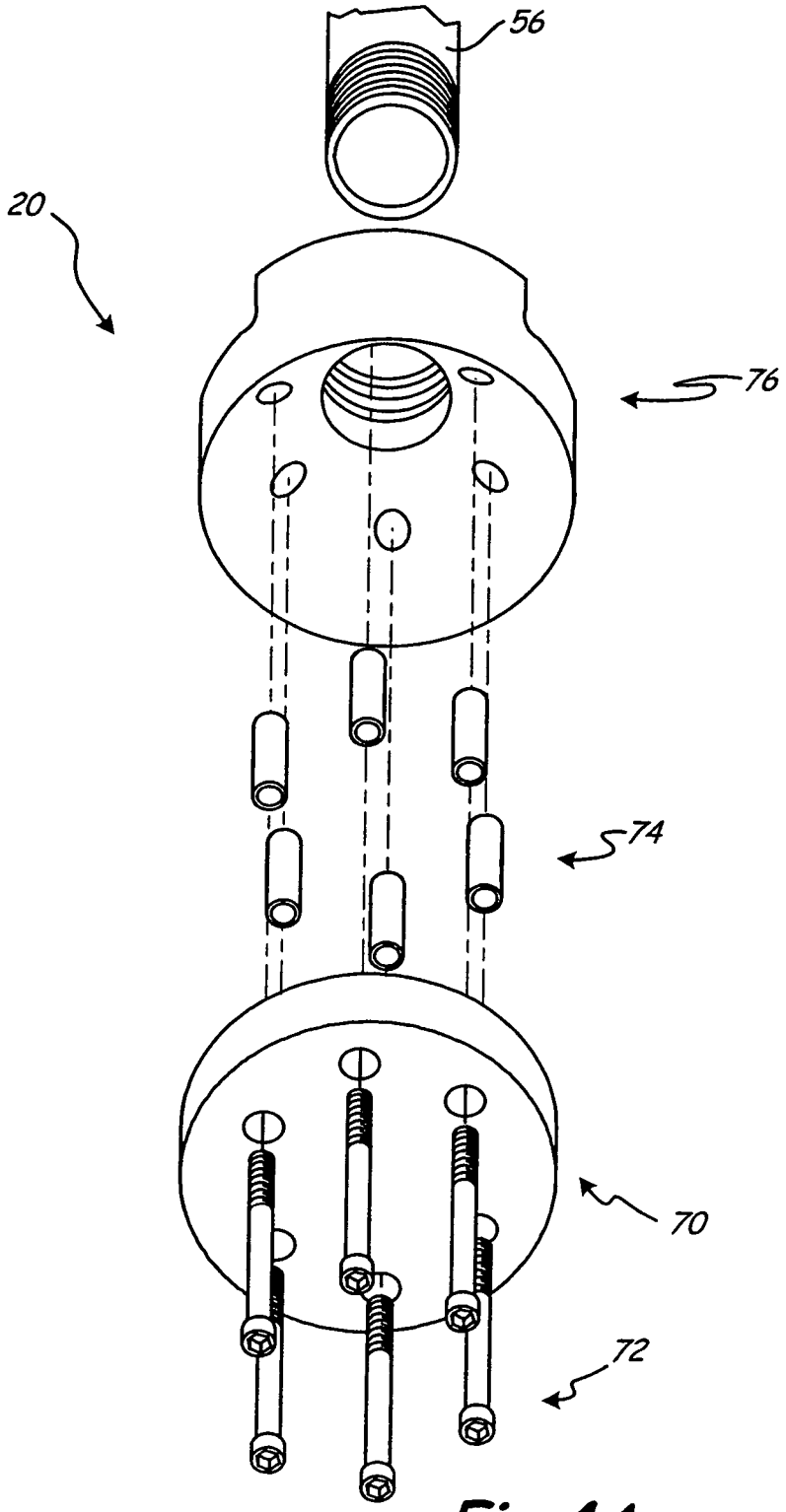
FIG. 4A is an exploded perspective assembly view of another embodiment of the nozzle and the outlet port of the system from FIG. 1 or FIG. 2.
Figure 4B:
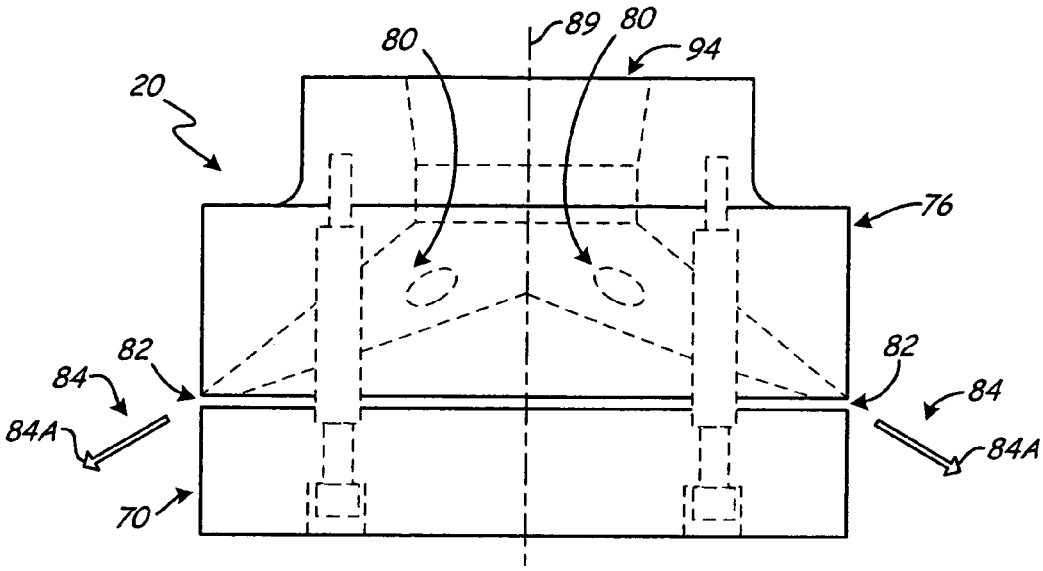
FIG. 4B is a side view of the nozzle from FIG. 4A as assembled.
Figure 4C:
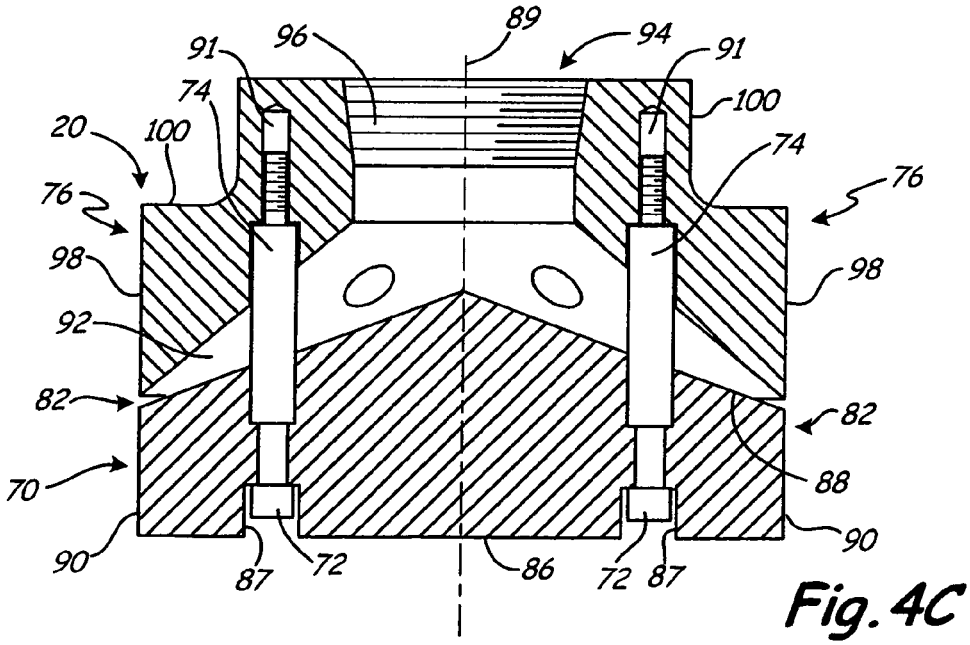
FIG. 4C is a cross sectional side view of the nozzle from FIG. 4B.

FIG. 4A shows an exploded perspective view of another embodiment of the nozzles 20, disposed below the pipe end 56. FIGS. 4B and 4C show the assembled nozzle 20 from FIG. 4A.

The nozzle 20 shown in FIGS. 4A to 4C does not include the channels 78A, 78B or lands 77A, 77B but otherwise has all the other features of the embodiment shown in FIGS. 3A to 3H. In FIGS. 4A to 4C, the deflector base 70 receives the fasteners 72 and spacers 74, which interconnect the deflector base 70 co-axially to the bonnet 76. The top convex surface 88 of the deflector base 70 and concave surface 92 of the bonnet 76 interface to define the flow passageway 80. The concave surface 92 of the bonnet 76 gives the suppressant within the flow passageway 80 a down angle with respect to the axis of symmetry 89 of the bonnet 76. Likewise, the deflector base 70 may be adapted impart a down angle to the suppressant within the flow passageway 80. The down angle the deflector base 70 imparts to the discharged suppressant flow may be the same as or different from the down angle the bonnet 76 imparts.

The small distance the deflector base 70 is spaced off the bonnet 76 (coupled with the different down angle of the deflector base 70 with respect to the down angle of the bonnet 76 in some embodiments) creates a small discharge port 82 along the outer edge of the deflector base 70 and bonnet 76. More specifically, the discharge port 82 is defined by the distance between the top convex surface 88 of the deflector base 70 and the bottom concave surface 92 of the bonnet 76 at the circumferential edge of each of those components. In one embodiment, the distance between the deflector base 70 and bonnet 76 at the discharge port 82 is between about 100 micrometers to about 200 micrometers (about 4/1000 inch to about 8/1000 inch).

The relatively small size of the discharge port 82 functions to choke the flow of the suppressant in the flow passageway 80 and shear the liquid suppressant in the liquid/gas flow mixture (via propagated shock waves) at the discharge port 82 to atomize (create liquid droplets smaller than about 10 micrometers (0.39 mils)) the liquid suppressant droplets in the discharge suppressant flow 84 which leaves the nozzle 20 and enters the fire zone. The shear produced at the discharge port 82 is the result of the discrepancy between the velocity of the suppressant flow (which is discharged at or near the speed of sound) and the velocity of the air in the fire zone.

The down angles of the features which define the flow passageway 80 direct the suppressant flow radially outward and downward through the flow passageway 80 and out through the discharge port 82. The down angle of the suppressant flow in the flow passageway 80 is correlated to the direction of the down angle flow 84A upon exiting the discharge port 82. Thus, the down angles of the top frustoconical surface 88, frustoconical surface 92, and channels 78 with respect to the axis 89 are responsible for generating the first flow perturbation, the down angle flow 84A perturbation. The direction of the down angle flow 84A away from the surface (such as a wall or ceiling) from which the nozzle 20 extends reduces the chances that the suppressant flow will impinge or attach to that surface. Thus, with the down angle flow 84A, greater dispersion and disbursement of liquid suppressant in the fire zone may be achieved. Alternatively, the features which define the flow passageway 80 may be given steep down angles such that the resulting down angle flow 84A is directed downward to a particular localized location in the fire zone.

Figure 4D:
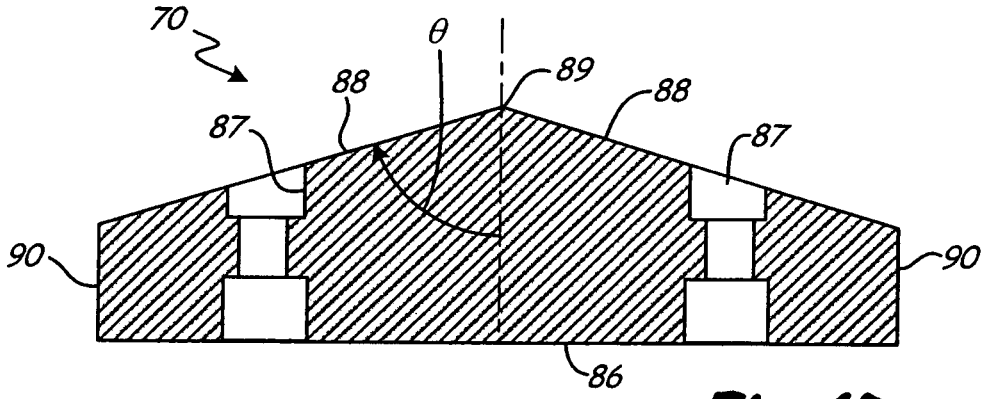
FIG. 4D is a side sectional view of a deflector base from the nozzle of FIG. 4A.
Figure 4E:
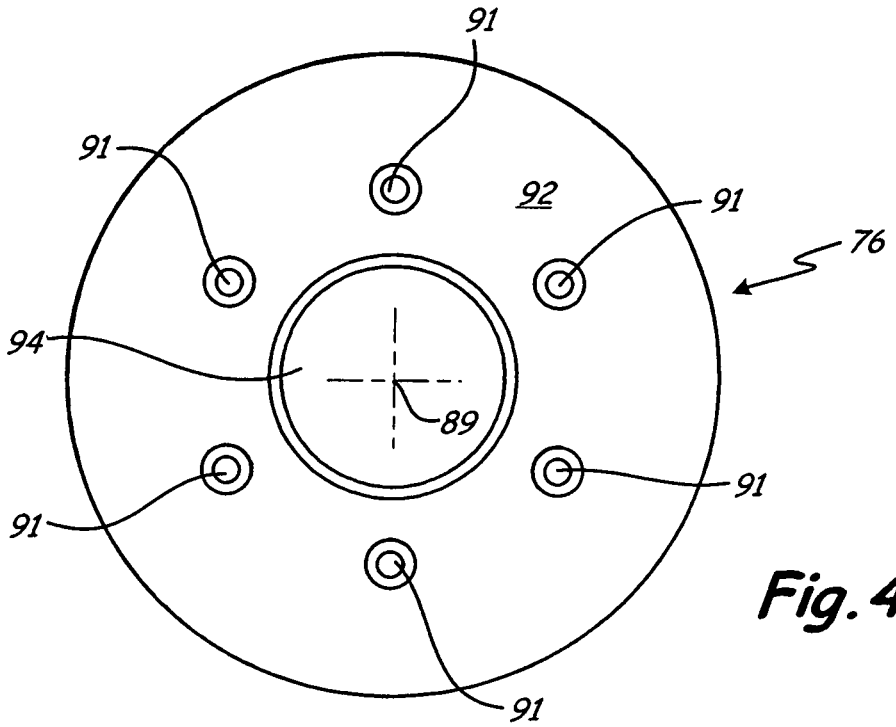
FIG. 4E is a bottom view of a bonnet from the nozzle of FIG. 4A.
Figure 4F:
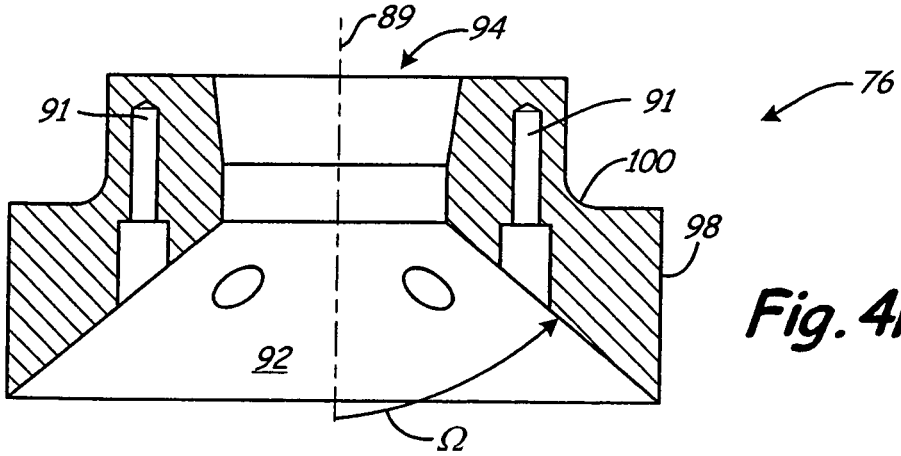
FIG. 4F is a sectional view of the bonnet from FIG. 4E.

FIG. 4D to FIG. 4F show the deflector base 70 and bonnet 76 from various perspectives. FIG. 4D illustrates the top frustoconical surface 88 of the deflector base 70. The surface 88 has a generally continuous convex shape and extends radially outward and downward from an apex at the axis 89 to the side surface 88. In FIG. 4D the top frustoconical surface 88 has a down angle θ with respect to the axis 89 of the deflector base 70. FIGS. 4E and 4F show the frustoconical surface 92 of the bonnet 76. The frustoconical surface 92 has a generally continuous concave shape and extends radially outward and downward from the inlet port 94 to the side surface 98. The frustoconical surface 92 has a down angle Ω which may differ from the down angle θ (FIG. 4D) of the top frustoconical surface 88. When the deflector base 70 is assembled below the bonnet 76 the various combinations of the down angle θ of the top frustoconical surface 88 and the down angle Ω of the frustoconical surface 92 impart various down angles to the suppressant discharged from the nozzle 20 (FIGS. 4B and 4C).

Although the present invention has been described with reference to preferred embodiments, workers skilled in the art will recognize that changes may be made in form and detail without departing from the spirit and scope of the invention.

The invention claimed is:

1. A nozzle for atomizing and dispersing a discharge flow of suppressant from a fire suppression system into a fire zone, the nozzle comprising:

a bonnet having a concave surface extending radially outward and downward from an inlet port, the inlet port extends along an axis of symmetry of the bonnet and receives an outlet end of a fire suppression delivery pipe to mount the bonnet to the pipe;

a deflector base co-axially aligned with and secured at a distance from the bonnet;

a discharge port at an outer edge of the nozzle and defined by a gap between the bonnet and the deflector base; and a flow passageway extending between the inlet port and the discharge port; wherein the discharge port and flow passageway are configured to impart a streamwise vorticity to the suppressant flow discharged from between the bonnet and deflector base; wherein the flow passageway is formed between interleaved channels and lands in the deflector base and bonnet.

2. The atomizing nozzle of claim 1, wherein the discharge port and flow passageway are configured to impart a down angle to the suppressant flow discharged from between the bonnet and deflector base.

3. The atomizing nozzle of claim 1, wherein the channels and lands have varying degrees of down angle with respect to the axis of symmetry such that the flow passageway becomes smaller as the flow passageway extends downward and outward from the inlet port to the discharge port.

4. The atomizing nozzle of claim 1, wherein the gap at the discharge port is between about 100 micrometers to about 200 micrometers to choke a suppressant flow from the flow passageway and produce atomized liquid or liquefied/gas suppressant droplets.

5. A nozzle for atomizing and dispersing a discharge flow of suppressant from a fire suppression system into a fire zone, the nozzle comprising:

a bonnet having a concave surface extending radially outward and downward from an inlet port, the inlet port extends along an axis of symmetry of the bonnet and receives an outlet end of a fire suppression delivery pipe to mount the bonnet to the pipe; and a deflector base co-axially aligned with and secured to the bonnet to define a flow passageway therebetween which imparts a down angle to a suppressant flow discharging from the flow passageway through a circumferential discharge port at an outer edge of the bonnet and deflector base;

a plurality of circumferentially alternating channels and lands in the deflector base and bonnet.

6. The atomizing nozzle of claim 5, wherein the discharge port has a height of between about 100 micrometers to about 200 micrometers to choke a suppressant flow from the flow passageway and produce atomized liquid or liquefied/gas suppressant droplets.

7. The atomizing nozzle of claim 5, wherein the discharge port has an alternating stepwise pattern around the circumference of the nozzle.

8. The atomizing nozzle of claim 5, wherein the deflector base has a convex surface and a generally frustoconical shape.

9. A nozzle for atomizing and dispersing a discharge flow of suppressant from a fire suppression system into a fire zone, the nozzle comprising:

a bonnet having a concave surface extending radially outward and downward from an inlet port, the inlet port extends along an axis of symmetry of the bonnet and receives an outlet end of a fire suppression delivery pipe to mount the bonnet to the pipe;

a deflector base co-axially aligned with and secured to the bonnet to define a flow passageway therebetween which imparts a down angle to a suppressant flow discharging from the flow passageway through a circumferential discharge port at an outer edge of the bonnet and deflector base; and a plurality of circumferentially alternating channels and lands in the deflector base and bonnet, wherein the channels and lands are interleaved such that the lands of the deflector base extend into the channels in the bonnet and lands of the bonnet extend into the channels in the deflector base.

10. The atomizing nozzle of claim 9, wherein the flow passageway formed between the interleaved channels and lands imparts a streamwise vorticity and multiple down angles to the suppressant flow discharging from the nozzle.

11. The atomizing nozzle of claim 9, wherein the sides of each of the channels and lands taper together as each channel and land extends radially inward toward the axes of the deflector base and bonnet to give each channel and land a wedge like or truncated wedge like shape.

12. The atomizing nozzle of claim 9, wherein the channels get wider and deeper relative to the lands of the deflector base or bonnet as each channel extends radially outward from the axis to the discharge port.

13. The atomizing nozzle of claim 9, wherein the channels and lands of the deflector base and bonnet have different down angles with respect to the axis of symmetry such that the flow passageway becomes smaller as the flow passageway extends downward and outward from the inlet port to the discharge port.

14. A method of atomizing and dispersing a discharge flow of suppressant from a fire suppression system into a fire zone, comprising:

delivering suppressant to an inlet port of nozzle that includes a bonnet and a deflector base; and passing a suppressant flow from the inlet port through a flow passageway and through a discharge port adjacent an outer edge of the bonnet and deflector base, wherein the discharge port is sized to choke the suppressant flow from the flow passageway and produce atomized liquid or liquefied/gas suppressant droplets;

wherein the flow passageway is formed between a a plurality circumferentially circumferentially alternating channels and lands in the deflector base and bonnet.

15. The method of claim 14, wherein the discharge port has a height between about 100 micrometers to about 200 micrometers.

16. The method of claim 14, wherein the step of passing the discharge through the flow passage and through the discharge port produces liquid or liquefied/gas suppressant droplets having a diameter of less than 10 micrometers.

17. A method of atomizing and dis dispersing a discharge flow of suppressant from a fire suppression system into a fire zone, comprising:

delivering suppressant to an inlet port of nozzle that includes a bonnet and a deflector base; and passing a suppressant flow from the inlet port through a flow passageway and through, a discharge port adjacent an outer edge of the bonnet and deflector base, wherein the discharge port is sized to choke the suppressant flow from the flow passageway and produce atomized liquid or liquefied/gas suppressant droplets;

wherein the flow passageway is formed between a plurality of circumferentially alternating channels and lands in the deflector base and bonnet, the channels and lands are interleaved such that the lands of the deflector base extend into the channels in the bonnet and lands of the bonnet extend into the channels in the deflector base.

18. The method of claim 7, wherein the step of passing the discharge through the flow passage and through the discharge port generates a down angle and a streamwise vorticity in the discharge flow from the nozzle.

* * * * *